US012075917B2

(12) United States Patent
Hou

(10) Patent No.: US 12,075,917 B2
(45) Date of Patent: Sep. 3, 2024

(54) INFLATABLE BED

(71) Applicant: DONGGUAN HONGYU PLASTIC CO., LTD, Dongguan (CN)

(72) Inventor: Guohai Hou, Nanchong (CN)

(73) Assignee: DONGGUAN HONGYU PLASTIC CO., LTD, Dongguan (CN)

( * ) Notice: Subject to any disclaimer, the term of this patent is extended or adjusted under 35 U.S.C. 154(b) by 0 days.

(21) Appl. No.: 18/336,398

(22) Filed: Jun. 16, 2023

(65) Prior Publication Data

US 2023/0320491 A1 Oct. 12, 2023

Related U.S. Application Data

(63) Continuation of application No. 18/198,703, filed on May 17, 2023, now abandoned, which is a continuation-in-part of application No. 16/749,843, filed on Jan. 22, 2020, now abandoned.

(30) Foreign Application Priority Data

Dec. 5, 2019 (CN) ..... 201922166255.6

(51) Int. Cl.
*A47C 27/08* (2006.01)

(52) U.S. Cl.
CPC ..... *A47C 27/082* (2013.01); *A47C 27/087* (2013.01)

(58) Field of Classification Search
CPC .... A47C 27/081; A47C 27/082; A47C 27/087
See application file for complete search history.

(56) References Cited

U.S. PATENT DOCUMENTS 1,610,898 A * 12/1926 Steiner ..... A47C 27/081 5/712
2,604,641 A * 7/1952 Reed ..... A47C 27/087 5/710
4,068,335 A * 1/1978 Phillips ..... A47C 27/085 5/687
4,541,135 A * 9/1985 Karpov ..... A47C 27/10 5/710
4,644,597 A * 2/1987 Walker ..... A47C 27/087 5/711
4,700,419 A * 10/1987 Santo ..... A47C 27/085 5/681
5,493,742 A * 2/1996 Klearman ..... A47C 27/082 5/500

(Continued)

*Primary Examiner* — Myles A Throop
(74) *Attorney, Agent, or Firm* — Nelson Mullins Riley & Scarborough LLP; Anthony A. Laurentano

(57) ABSTRACT

An inflatable bed having a main air chamber, a first pull strap group, and a second pull strap group. The main chamber includes an annular air chamber having a first annular air chamber and a second annular air chamber, which are in communication with each other. The first annular air chamber and the second annular air chamber are provided at two opposite sides of the main air chamber. The first pull strap group is connected to both an inner wall of the main air chamber and an outer wall of the first annular air chamber, and the second pull strap group is connected to both the inner wall of the main air chamber and an outer wall of the second annular air chamber. The pull strap group connections provide a pulling structure that is formed between the adjacent air chambers.

10 Claims, 3 Drawing Sheets

(56) References Cited

U.S. PATENT DOCUMENTS 5,598,593 A * 2/1997 Wolfe ..... A47C 27/087 5/710
5,852,839 A 12/1998 Gancy
6,240,584 B1 * 6/2001 Perez ..... A47C 27/082 5/713
7,089,618 B1 * 8/2006 Metzger ..... A47C 27/087 5/709
7,353,555 B2 * 4/2008 Lau ..... A47C 27/081 5/711
7,591,036 B2 * 9/2009 Lin ..... A47C 27/081 5/713
9,254,047 B1 * 2/2016 Schermel ..... A47C 27/083
10,582,778 B2 * 3/2020 Ocegueda Gallaga ..... A47C 27/087
10,631,659 B2 4/2020 Xia et al.
11,058,226 B2 * 7/2021 Hsu ..... A47C 27/087
11,311,115 B2 * 4/2022 Gao ..... A47G 9/1027
11,324,335 B2 * 5/2022 Huang ..... A47C 31/116
11,503,920 B1 * 11/2022 Shi ..... A47C 27/10
D979,984 S * 3/2023 Shi ..... D6/604
D982,359 S * 4/2023 Shi ..... D6/604
2003/0101516 A1 * 6/2003 Hsu ..... A47C 27/087 5/710
2003/0159218 A1 * 8/2003 Lin ..... A47C 4/54 5/710
2004/0074004 A1 4/2004 Boso et al.
2005/0076449 A1 4/2005 Yuan
2005/0223495 A1 10/2005 Wu
2006/0016015 A1 * 1/2006 Boso ..... A47C 27/082 5/710
2006/0218728 A1 10/2006 Liu
2006/0265810 A1 * 11/2006 Wu ..... A47C 27/081 5/712
2007/0124864 A1 * 6/2007 Lau ..... A47C 27/081 5/711
2007/0169274 A1 * 7/2007 Boso ..... A47C 27/081 5/706
2008/0078032 A1 4/2008 Boyd
2009/0165211 A1 * 7/2009 Song ..... A47C 27/087 5/706
2015/0201760 A1 * 7/2015 Lin ..... A47C 27/087 5/710
2017/0196368 A1 * 7/2017 Liu ..... A47C 27/16
2019/0246805 A1 * 8/2019 Huang ..... B29C 66/438
2020/0205579 A1 7/2020 Wen
2021/0169232 A1 * 6/2021 Hou ..... A47C 27/087
2021/0196053 A1 * 7/2021 Li ..... A47C 27/10
2023/0029332 A1 * 1/2023 Xia ..... A47C 27/087

* cited by examiner

INFLATABLE BED

RELATED APPLICATIONS

The present application is a continuation of U.S. patent application Ser. No. 18/198,703 filed May 17, 2023, which is a is a continuation-in-part of U.S. patent application Ser. No. 16/749,843, filed Jan. 22, 2020, which claims priority to Chinese Patent Application No. 201922166255.6, filed with the Chinese Patent Office on Dec. 5, 2019, titled INFLATABLE MATTRESS. The contents of the prior applications are incorporated herein by reference in their entirety.

TECHNICAL FIELD

The present disclosure relates to the field of articles for daily use, particularly to an inflatable bed.

BACKGROUND ART

The inflatable bed, with high flexibility, is used as a bed or a mattress after being inflated, and can be folded when being not inflated. It has a small volume, is convenient to store and carry, and is more and more widely applied to places for leisure entertainment, medical care, and home life. Most of the inflatable beds are provided with chamber(s) inside, and the inflatable bed is enabled to have a certain supporting force by inflating the chamber. There are many types of inflatable beds in the prior art. The inflatable beds are generally provided with several chambers, and the several chambers communicate with each other through vent holes so as to facilitate the inflation. However, each of the chambers of the existing multi-chamber inflatable bed operates independently and has poor collaboration. When the pressure on different chamber is inconsistent, multiple chambers cannot effectively regulate the air pressure, resulting in poor stability and comfort.

SUMMARY

An objective of the present disclosure lies in providing an inflatable bed, which can improve the stability of the inflatable bed in an inflated state, further improve the comfort in use, and meanwhile improve the aesthetic property.

Embodiments of the present disclosure are realized as follows:

the present disclosure provides an inflatable bed, including:

a main air chamber, a first pull strap group, and a second pull strap group, wherein a first annular air chamber and a second annular air chamber which are in communication with each other are provided in the main air chamber, wherein the first annular air chamber and the second annular air chamber are respectively provided at two opposite sides of the main air chamber, the first pull strap group is connected to both an inner wall of the main air chamber and an outer wall of the first annular air chamber, and the second pull strap group is connected to both the inner wall of the main air chamber and an outer wall of the second annular air chamber.

In an optional embodiment, the main air chamber includes a top wall, a bottom wall, and an annular enclosing wall (surrounding wall), the top wall and the bottom wall are arranged opposite to each other, the annular enclosing wall is located between the top wall and the bottom wall, and two ends of the annular enclosing wall are connected to the top wall and the bottom wall, respectively.

In an optional embodiment, the first annular air chamber has a first annular enclosing sheet, the first annular enclosing sheet extends in a circumferential direction of the annular enclosing wall, a first inner annular edge and a first outer annular edge of the first annular enclosing sheet are both connected to the top wall, the first inner annular edge is located in an area defined by the first outer annular edge; and the first annular enclosing sheet is provided with a first inflating hole in communication with the main air chamber.

In an optional embodiment, the first pull strap group includes a first annular pull strap, and the first annular pull strap has a first annular connecting edge and a second annular connecting edge, wherein the first annular connecting edge is connected to the first annular enclosing sheet, and the second annular connecting edge is connected to the annular enclosing wall; the first annular pull strap, the annular enclosing wall, and the first annular enclosing sheet jointly define a first inclined-pulled chamber, and a first communicating part communicated with the first inclined-pulled chamber is provided on the first annular pull strap.

In an optional embodiment, the first annular pull strap has a first bending section, and the first communicating part is formed as a gap located at the first bending section.

In an optional embodiment, the second annular air chamber has a second annular enclosing sheet, wherein both a second inner annular edge and a second outer annular edge of the second annular enclosing sheet are connected to the bottom wall, the second inner annular edge is located in an area defined by the second outer annular edge; and the second annular enclosing sheet is provided with a second inflating hole in communication with the main air chamber.

In an optional embodiment, the second pull strap group includes a second annular pull strap, and the second annular pull strap has a third annular connecting edge and a fourth annular connecting edge, wherein the third annular connecting edge is connected to the second annular enclosing sheet, and the fourth annular connecting edge is connected to the annular enclosing wall; the second annular pull strap, the annular enclosure wall, and the second annular enclosing sheet jointly define a second inclined-pulled chamber, and a second communicating part communicated with the second inclined-pulled chamber is arranged on the second annular pull strap.

In an optional embodiment, the second annular pull strap has a second bending section, and the second communicating part is formed as a gap located at the second bending section.

In an optional embodiment, multiple shaping pull straps are provided in the main air chamber.

In an optional embodiment, the inflatable bed further includes an air pump and an air release valve, the air pump is connected to the main air chamber, the air pump is configured to inflate the main air chamber; the main air chamber is provided with an exhaust hole, and the air release valve is provided at the exhaust hole, wherein the air release valve is configured to open or close the exhaust hole.

The embodiments of the present disclosure have the following beneficial effects:

to sum up, for the inflatable bed provided in the present embodiment, two annular air chambers are arranged in the main air chamber, wherein the first annular air chamber and the second annular air chamber are arranged opposite to each other, and the two annular air chambers are located on two sides of the main air chamber in a thickness direction, respectively, and the first annular air chamber and the second annular air chamber both communicate with the main air chamber.

In this way, not only the stability of edges of the inflatable bed is enhanced through the cooperation structure of the first annular air chamber and the second annular air chamber, but also the volume of the main air chamber is reduced through the cooperation between the first annular air chamber and the second annular air chamber, further enhancing the structural strength of a part of the main air chamber, making the main air chamber have higher stability, and further allowing the whole inflatable bed to have higher stability, and in use, the inflatable bed is not easy to deform and has higher comfort. During use, the two annular air chambers are communicated with the main chamber, and the pressure can be regulated collaboratively, resulting in high stability.

BRIEF DESCRIPTION OF DRAWINGS

In order to more clearly illustrate technical solutions of embodiments of the present disclosure, drawings which need to be used in the embodiments will be introduced briefly below, and it should be understood that the drawings below merely show some embodiments of the present disclosure, therefore, they should not be considered as limitation on the scope, and those ordinarily skilled in the art still could obtain other relevant drawings according to these drawings, without using any creative efforts.

REFERENCE SIGNS

Figure 1:
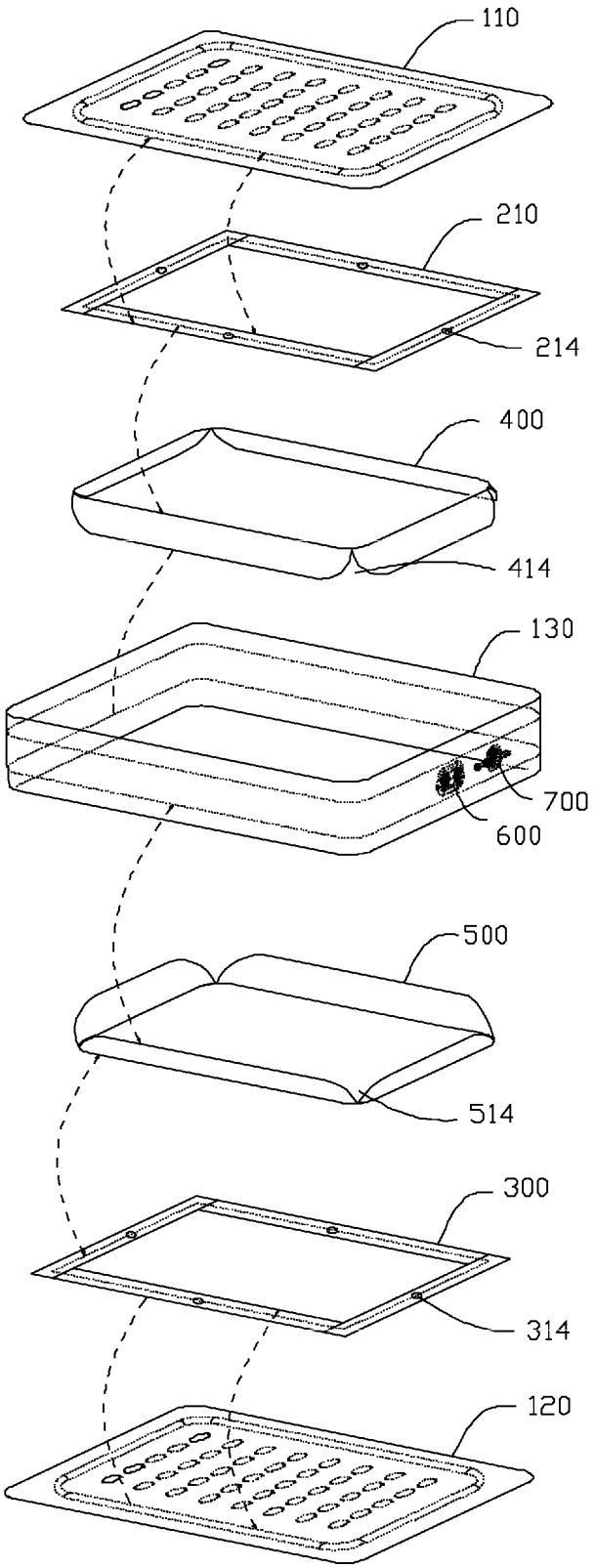
FIG. 1 is an exploded structural schematic view of an inflatable bed in an embodiment of the present disclosure.
Figure 2:
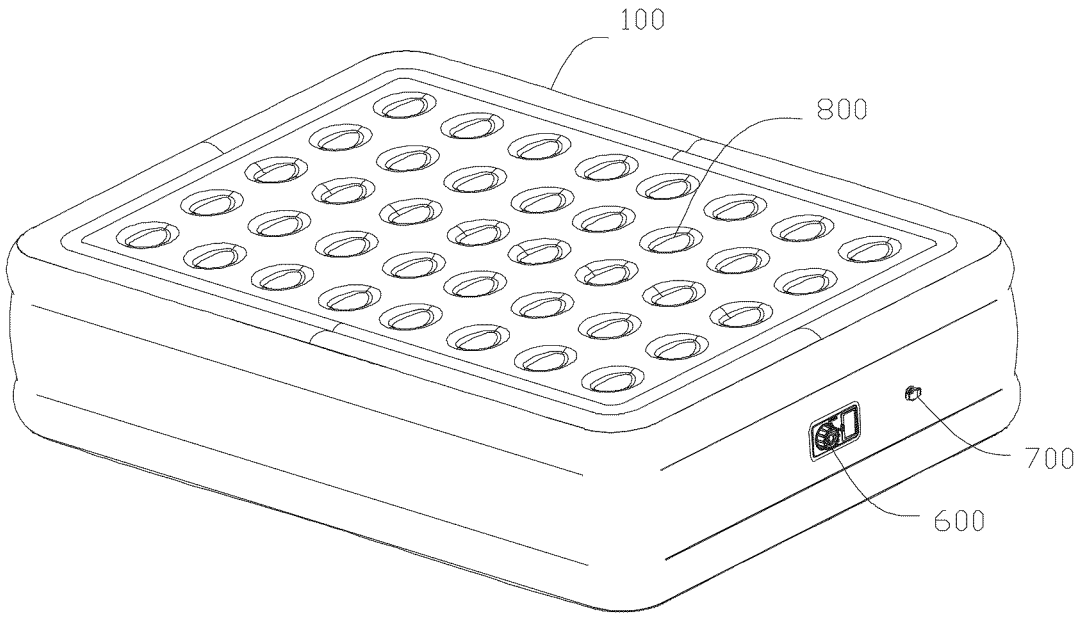
FIG. 2 is a schematic view of an assembly structure of the inflatable bed in an embodiment of the present disclosure.

100—main air chamber; 110—top wall; 120—bottom wall; 130—annular enclosing wall; 200—first annular air chamber; 210—first annular enclosing sheet; 211—first inner annular edge; 212—first outer annular edge; 213—first widening sheet; 214—first inflating hole; 300—second annular air chamber; 310—second annular enclosing sheet; 311—second inner annular edge; 312—second outer annular edge; 313—second widening sheet; 314—second inflating hole; 400—first pull strap group; 401—first inclined-pulled chamber; 410—first annular pull strap; 411—first annular connecting edge; 412—second annular connecting edge; 413—third widening sheet; 414—first communicating part; 500—second pull strap group; 501—second inclined-pulled chamber; 510—second annular pull strap; 511—third annular connecting edge; 512—fourth annular connecting edge; 513—fourth widening sheet; 514—second communicating part; 600—air pump; 700—air release valve; 800—shaping pull strap.

DETAILED DESCRIPTION OF EMBODIMENTS

In order to make the objectives, technical solutions, and advantages of the embodiments of the present disclosure clearer, the technical solutions in the embodiments of the present disclosure will be described below clearly and completely in conjunction with the accompanying drawings in the embodiments of the present disclosure. Apparently, some but not all embodiments of the present disclosure are described. Generally, components in the embodiments of the present disclosure, as described and shown in the drawings herein, may be arranged and designed in various different configurations.

Therefore, the detailed description below of the embodiments of the present disclosure provided in the drawings is not intended to limit the scope of the claimed present disclosure, but merely illustrates chosen embodiments of the present disclosure. Based on the embodiments of the present disclosure, all of other embodiments, obtained by a person ordinarily skilled in the art without using creative efforts, shall fall within the scope of protection of the present disclosure.

It should be noted that similar reference signs and letters represent similar items in the drawings, therefore, once a certain item is defined in one drawing, it is not needed to be further defined or explained in subsequent drawings.

In the description of the present disclosure, it should be noted that orientation or positional relationships indicated by terms such as "center", "upper", "lower", "left", "right", "vertical", "horizontal", "inner", and "outer" are based on orientation or positional relationships as shown in the drawings or orientation or positional relationships of a product of the present disclosure when it is conventionally placed in use, merely for facilitating describing the present disclosure and simplifying the description, rather than indicating or suggesting that the related devices or elements must have the specific orientation or configured and operated in a specific orientation, therefore, they should not be construed as limiting the present disclosure. Besides, terms "first", "second", "third", etc. are merely for distinguishing the description, but should not be construed as indicating or implying importance in the relativity.

Moreover, the terms "horizontal", "vertical" and the like do not mean that the parts are required to be absolutely horizontal or overhanging, but may be slightly inclined. For example, by "horizontal" it merely means that a structure is more horizontal in comparison with "vertical", rather than being completely horizontal, while the structure can be slightly inclined.

In the description of the present disclosure, it should also be noted that unless otherwise expressly specified or defined, terms "provide", "mount", "couple", and "connect" should be understood in a broad sense. For example, a connection may be a fixed connection or a detachable connection or an integral connection, may be a mechanical connection or an electric connection, or may be direct coupling or indirect coupling via an intermediary, or internal communication between two elements. For a person ordinarily skilled in the art, specific meanings of the above-mentioned terms in the present disclosure can be understood according to specific circumstances.

At present, the inflatable bed is used more and more frequently, and in order to improve the comfort and the stability of using the inflatable bed, people designed various different types of inflatable beds. Common inflatable beds include five air chambers, wherein by adding two annular air chambers at a top edge and a bottom edge of the main air chamber, respectively, so as to form a five-air-chamber inflatable bed structure, the overall stability may be improved, but in practical use, multiple annular air chambers work independently, resulting in poor collaboration, so that the inflatable bed as a whole has a small adjustable range, and the use comfort is not high.

In view of this, the designer provides an inflatable bed, which can improve the stability of the inflatable bed in an inflated state, also can improve the comfort, and the inflatable bed also has a higher aesthetic property after being inflated.

Referring to FIG. 1-FIG. 5, the present embodiment provides a main air chamber 100, a first pull strap group 400, and a second pull strap group 500. A first annular air chamber 200 and a second annular air chamber 300 which are in communication with each other are provided in the main air chamber 100, wherein the first annular air chamber 200 and the second annular air chamber 300 are respectively provided at two opposite sides of the main air chamber 100 in a thickness direction. The first pull strap group 400 is connected to both an inner wall of the main air chamber 100 and an outer wall of the first annular air chamber 200, and the second pull strap group 500 is connected to both the inner wall of the main air chamber 100 and an outer wall of the second annular air chamber 300.

Referring to FIG. 1, in the present embodiment, the description is made by taking the main air chamber 100 being in a rectangular parallelepiped shape as an example. That is, the main air chamber 100 is in a rectangular parallelepiped shape after being inflated, and two side portions of the main air chamber 100 in a thickness direction are a top portion and a bottom portion, respectively. Correspondingly, the first annular air chamber 200 and the second annular air chamber 300 both extend in a quadrilateral shape, and specifically, the first annular air chamber 200 is provided surrounding the top portion of the main air chamber 100, and the second annular air chamber 300 is provided surrounding the bottom portion of the main air chamber 100.

Optionally, the main air chamber 100 includes a top wall 110, a bottom wall 120, and an annular enclosing wall 130, wherein the top wall 110 and the bottom wall 120 are arranged opposite to each other, the annular enclosing wall 130 is located between the top wall 110 and the bottom wall 120, and two ends of the annular enclosing wall 130 are connected to the top wall 110 and the bottom wall 120, respectively. It should be understood that the top wall 110 and the bottom wall 120 are both rectangular sheets, and the annular enclosing wall 130 is in a rectangular cylinder structure. Moreover, an edge of the top wall 110 may be in sealed connection with one end of the annular enclosing wall 130 in a manner of heat bonding, and an edge of the bottom wall 120 may be in sealed connection with the other end of the annular enclosing wall 130 in the manner of heat bonding.

Further, the annular enclosing wall 130 is provided with an assembling hole and an exhaust hole. An air pump 600 is provided at the assembling hole, and the air pump 600 is matched with a hole wall of the assembling hole in a sealed manner. When in use, the inflatable bed is inflated by the air pump 600. Meanwhile, an air release valve 700 is provided at the exhaust hole, and the air release valve 700 is configured to open or close the exhaust hole. When the inflatable bed does not need to be used, gas (air) in the inflatable bed needs to be discharged, at this time, it only needs to open the air release valve 700, and the gas in the inflatable bed can be discharged from the exhaust hole. Obviously, in the inflated state, the air release valve 700 is always in a state of closing the exhaust hole. The air release valve may be a rubber plug. The rubber plug is connected to the annular enclosing wall 130 through an elastic strip. Even when being in a state of opening the exhaust hole, the rubber plug is still borne by an elastic body, will not fall down, is not easy to lose, and is reliable to use.

It should be understood that, in other embodiments, the assembling hole and the exhaust hole also may be disposed on the top wall 110 or the bottom wall 120, in addition, the number of assembling hole and the exhaust hole is selected as needed, which is not limited specifically in this embodiment.

Figure 4:
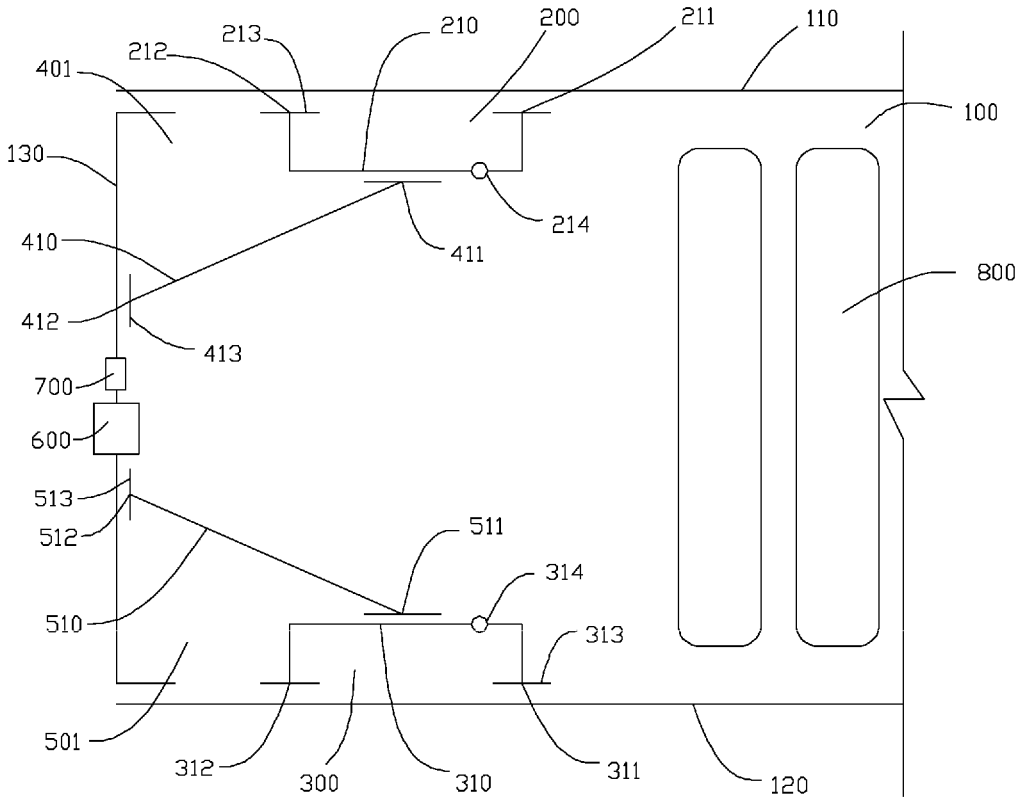
FIG. 4 is a partial disassembling structural schematic view of the inflatable bed in an embodiment of the present disclosure.

Referring to FIG. 1 and FIG. 4, optionally, the first annular air chamber 200 has a first annular enclosing sheet 210, and the second annular air chamber 300 has a second annular enclosing sheet 310. The first annular enclosing sheet 210 and the second annular enclosing sheet 310 are both rectangular ring sheets.

Specifically, the first annular enclosing sheet 210 has a first inner annular edge 211 and a first outer annular edge 212, the first inner annular edge 211 is located in an area defined by the first outer annular edge 212, and the first inner annular edge 211 and the first outer annular edge 212 are of a similar rectangular shape. The first inner annular edge 211 and the first outer annular edge 212 are both connected to the top wall 110, for example, the first inner annular edge 211 and the first outer annular edge 212 are both in sealed connection with the top wall 110 in the manner of heat bonding. In this way, the first annular enclosing sheet 210 and the top wall 110 together define the first annular air chamber 200, that is, the first annular air chamber 200 and the main air chamber 100 share the top wall 110, thus saving materials.

Meanwhile, the first annular enclosing sheet 210 is provided with a first inflating hole 214, wherein the first inflating hole 214 is communicated with the main air chamber 100 and the first annular air chamber 200, and the number of the first inflating hole 214 can be one or several, wherein when the number of the first inflating hole 214 is several, the several first inflating holes 214 are formed at intervals in annular direction of the first annular enclosing sheet 210.

Referring to FIG. 1-FIG. 4, the second annular enclosing sheet 310 has a second inner annular edge 311 and a second outer annular edge 312, the second inner annular edge 311 is located in an area defined by the second outer annular edge 312, and the second inner annular edge 311 and the second outer annular edge 312 are of a similar rectangular shape. The second inner annular edge 311 and the second outer annular edge 312 are both connected to the bottom wall 120; for example, the second inner annular edge 311 and the second outer annular edge 312 are both in sealed connection with the bottom wall 120 in the manner of heat bonding. In this way, the second annular enclosing sheet 310 and the bottom wall 120 together define the second annular air chamber 300, that is, the second annular air chamber 300 and the main air chamber 100 share the top wall 110, thus saving materials.

Meanwhile, the second annular enclosing sheet 310 is provided with a second inflating hole 314, wherein the second inflating hole 314 is communicated with the main air chamber 100 and the second annular air chamber 300, and the number of the second inflating hole 314 can be one or several, wherein when the number of the second inflating hole 314 is several, the several second inflating holes 314 are formed at intervals in annular direction of the second annular enclosing sheet 310.

In the present embodiment, optionally, the first pull strap group 400 includes a first annular pull strap 410, wherein the first annular full strap 410 is in a rectangular ring structure, and the first annular pull strap 410 has four bending sections. Each bending section is formed with a first communicating part 414, and the first communicating part 414 is a gap.

Specifically, the first annular pull strap 410 has a first annular connecting edge 411 and a second annular connecting edge 412, wherein the first annular connecting edge 411 is connected to a middle position of the first annular enclosing sheet 210, the second annular connecting edge 412 is connected to the annular enclosing wall 130, and a distance between the first annular connecting edge 411 and the top wall 110 is less than a distance between the second annular connecting edge 412 and the top wall 110. In addition, the gap is located on the second annular connecting edge 412. In this design, the first annular pull strap 410, the annular enclosing wall 130, and the first annular enclosing sheet 210 jointly define the first inclined-pulled chamber 401, and the first inclined-pulled chamber 401 is communicated with the main air chamber 100 through the first inflating hole 214.

Moreover, as the first annular connecting edge 411 is connected to the middle portion of the first annular enclosing sheet 210, that is, the first annular connecting edge 411 is not directly connected to the top wall 110, but is directly connected to the first annular enclosing sheet 210, such that the first annular enclosing sheet 210, the top wall 110, the first annular pull strap 410, and the annular enclosing wall 130 form a structure in which the first annular enclosing sheet, the top wall, the first annular pull strap, and the annular enclosing wall pull each other, and a pulling force of the first annular pull strap 410 acting on the top wall 110 is dispersed through the first annular enclosing sheet 210, thus improving the stability of the structure. The main air chamber 100 is communicated with the first annular air chamber 200 through the first inflating hole 214, and the first inclined-pulled air chamber and the main air chamber 100 are communicated through the first inflating hole 214. In this way, multiple air chambers are communicated with each other and work collaboratively to carry the pressure evenly.

Meanwhile, a distance between the first annular connecting edge 411 and the top wall 110 is A, and a distance between the second annular connecting edge 412 and the top wall 110 is B, where A is smaller than B, that is, the first annular pull strap 410 is arranged obliquely relative to the top wall 110, the first annular pull strap 410 is in a state of being inclined-pulled, and has higher stability.

In the present embodiment, optionally, the second pull strap group 500 includes a second annular pull strap 510, wherein the second annular pull strap 510 is in a rectangular ring structure, and the second annular pull strap 510 has four bending sections. Each bending section is formed with a second communicating part 514, and the second communicating part 514 is a gap. Specifically, the second annular pull strap 510 has a third annular connecting edge 511 and a fourth annular connecting edge 512, wherein the third annular connecting edge 511 is connected to a middle position of the second annular enclosing sheet 310, the fourth annular connecting edge 512 is connected to the annular enclosing wall 130, and a distance between the third annular connecting edge 511 and the bottom wall 120 is less than a distance between the fourth annular connecting edge 512 and the bottom wall 120. In addition, the gap is located on the fourth annular connecting edge 512. In this design, the second annular pull strap 510, the annular enclosing wall 130, and the second annular enclosing sheet 310 jointly define the second inclined-pulled chamber 501, and the second inclined-pulled chamber 501 is communicated with the main air chamber 100 through the second inflating hole 314.

Moreover, as the second annular connecting edge 412 is connected to the middle portion of the second annular enclosing sheet 310, that is, the second annular connecting edge 412 is not directly connected to the bottom wall 120, but is directly connected to the second annular enclosing sheet 310, such that the second annular enclosing sheet 310, the bottom wall 120, the second annular pull strap 510, and the annular enclosing wall 130 form a structure in which the second annular enclosing sheet, the bottom wall, the second annular pull strap, and the annular enclosing wall pull each other, and a pulling force of the second annular pull strap 510 acting on the bottom wall 120 is dispersed through the second annular enclosing sheet 310, thus improving the stability of the structure. The main air chamber 100 is communicated with the second annular air chamber 300 through the second inflating hole 314, and the second inclined-pulled air chamber and the main air chamber 100 are communicated through the second inflating hole 314. In this way, multiple air chambers are communicated with each other and work collaboratively to carry the pressure evenly.

Meanwhile, a distance between the third annular connecting edge 511 and the bottom wall 120 is C, and a distance between the fourth annular connecting edge 512 and the bottom wall is D, where C is smaller than D, that is, the second annular pull strap 510 is arranged obliquely relative to the bottom wall 120, the second annular pull strap 510 is in a state of being inclined-pulled, and has higher stability.

Figure 3:
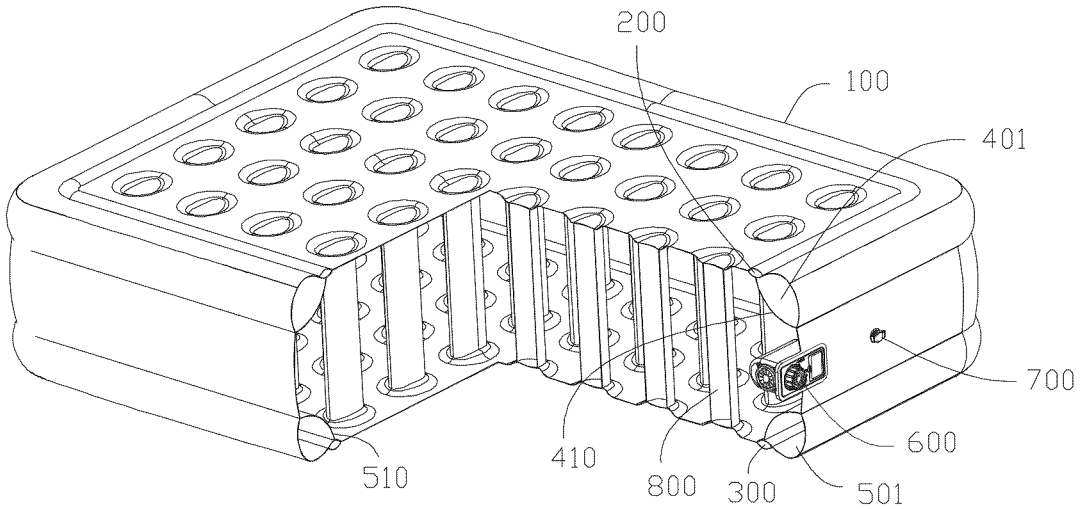
FIG. 3 is a partial sectional structural schematic view of the inflatable bed in an embodiment of the present disclosure.
Figure 5:
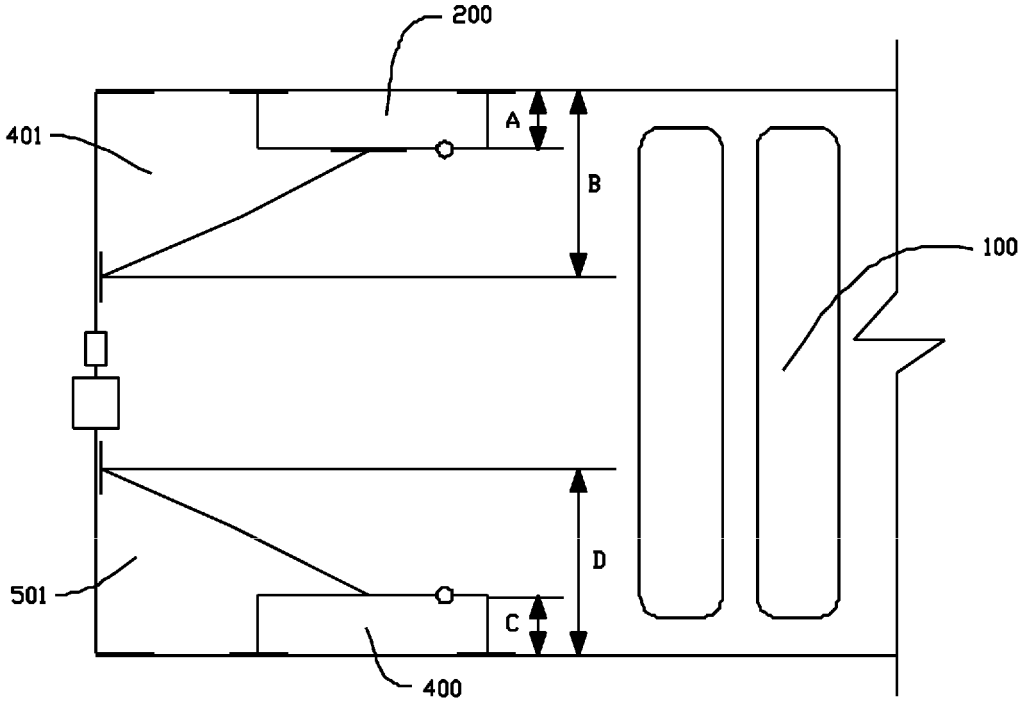
FIG. 5 is a partial splicing structural schematic view of the inflatable bed in an embodiment of the present disclosure.

Referring to FIG. 3-FIG. 5, during inflation, the air pump 600 is turned on, and the main air chamber 100 is inflated, meanwhile, gas (air) can enter the first annular air chamber 200 from the first inflating hole 214, enter the second annular air chamber 300 from the second inflating hole 314, enter the first inclined-pulled air chamber from the first communicating part 414, and enter the second inclined-pulled air chamber from the second communicating part 514. The multiple air chambers can be inflated simultaneously, thus the inflation efficiency is high. It should be noted that, the numbers of first inflating holes 214, second inflating holes 314, first communicating part 414, and second communicating part 514 are selected as required.

It should be understood that, in order to improve the sealing property and reduce the manufacturing difficulty, a first widening sheet 213 is provided at each of the first inner annular edge 211 and the second outer annular edge 312 of the first annular enclosing sheet 210; a second widening sheet 313 is provided at each of the second inner annular edge 311 and the second outer annular edge 312 of the second annular enclosing sheet 310; a third widening sheet 413 is provided at each of the first annular connecting edge 411 and the second annular connecting edge 412 of the first annular pull strap 410; and a fourth widening sheet 513 is provided at each of the third annular connecting edge 511 and the fourth annular connecting edge 512 of the second annular pull strap 510.

In addition, in order to improve the stability of the main air chamber 100, multiple shaping pull straps 800 are provided in the main air chamber 100, and two ends of each shaping pull strap 800 are respectively in sealed connection with the top wall 110 and the bottom wall 120.

In the inflatable bed provided in the present embodiment, a pulling structure is formed between adjacent air chambers, so that the inflatable bed has higher overall stability, is not easy to deform during use, and has higher comfort. Meanwhile, the structure of the inflatable bed after inflation is stable, and has more beautiful appearance.

The above-mentioned are merely preferred examples of the present disclosure and are not used to limit the present disclosure. For one skilled in the art, various modifications and changes may be made to the present disclosure. Any modifications, equivalent replacements, improvements, and so on, made within the spirit and principle of the present disclosure, should be covered within the scope of protection of the present disclosure.

What is claimed is:

1. An inflatable bed, comprising:

a main air chamber, a first pull strap group, and a second pull strap group, wherein a first annular air chamber and a second annular air chamber which are in communication with each other are provided in the main air chamber, and the first annular air chamber and the second annular air chamber are respectively provided at two opposite sides of the main air chamber, wherein the first pull strap group is connected to both an inner wall of the main air chamber and an outer wall of the first annular air chamber, and the second pull strap group is connected to both the inner wall of the main air chamber and an outer wall of the second annular air chamber, wherein the main air chamber has a top wall, a bottom wall, and an annular enclosing wall, wherein the top wall and the bottom wall are arranged opposite to each other, the annular enclosing wall is located between the top wall and the bottom wall, and two ends of the annular enclosing wall are connected to the top wall and the bottom wall, respectively, wherein the first annular air chamber has a first annular enclosing sheet, the first annular enclosing sheet extends in a circumferential direction of the annular enclosing wall, a first inner annular edge and a first outer annular edge of the first annular enclosing sheet are both connected to the top wall, the first inner annular edge is located in an area defined by the first outer annular edge, and the first annular enclosing sheet is provided with a first inflating hole in communication with the main air chamber.

2. The inflatable bed according to claim 1, wherein the first pull strap group includes a first annular pull strap, and the first annular pull strap has a first annular connecting edge and a second annular connecting edge, wherein the first annular connecting edge is connected to the first annular enclosing sheet, and the second annular connecting edge is connected to the annular enclosing wall; the first annular pull strap, the annular enclosing wall, and the first annular enclosing sheet jointly define a first inclined-pulled chamber, and a first communicating part communicated with the first inclined-pulled chamber is formed on the first annular pull strap.

3. The inflatable bed according to claim 2, wherein the first annular pull strap has a first bending section, and the first communicating part is formed as a gap located at the first bending section.

4. The inflatable bed according to claim 3, wherein the second annular air chamber has a second annular enclosing sheet, wherein a second inner annular edge and a second outer annular edge of the second annular enclosing sheet are both connected to the bottom wall, the second inner annular edge is located in an area defined by the second outer annular edge, and the second annular enclosing sheet is provided with a second inflating hole in communication with the main air chamber.

5. The inflatable bed according to claim 2, wherein the second annular air chamber has a second annular enclosing sheet, wherein a second inner annular edge and a second outer annular edge of the second annular enclosing sheet are both connected to the bottom wall, the second inner annular edge is located in an area defined by the second outer annular edge, and the second annular enclosing sheet is provided with a second inflating hole in communication with the main air chamber.

6. The inflatable bed according to claim 1, wherein the second annular air chamber has a second annular enclosing sheet, wherein a second inner annular edge and a second outer annular edge of the second annular enclosing sheet are both connected to the bottom wall, the second inner annular edge is located in an area defined by the second outer annular edge, and the second annular enclosing sheet is provided with a second inflating hole in communication with the main air chamber.

7. The inflatable bed according to claim 6, wherein the second pull strap group includes a second annular pull strap, and the second annular pull strap has a third annular connecting edge and a fourth annular connecting edge, wherein the third annular connecting edge is connected to the second annular enclosing sheet, and the fourth annular connecting edge is connected to the annular enclosing wall; the second annular pull strap, the annular enclosure wall, and the second annular enclosing sheet jointly define a second inclined-pulled chamber, and a second communicating part communicated with the second inclined-pulled chamber is formed on the second annular pull strap.

8. The inflatable bed according to claim 7, wherein the second annular pull strap has a second bending section, and the second communicating part is formed as a gap located at the second bending section.

9. The inflatable bed according to claim 1, wherein multiple shaping pull straps are provided in the main air chamber.

10. The inflatable bed according to claim 1, wherein the inflatable bed further comprises an air pump and an air release valve, wherein the air pump is connected to the main air chamber, and the air pump is configured to inflate the main air chamber; the main air chamber is provided with an exhaust hole, wherein the air release valve is provided at the exhaust hole, and the air release valve is configured to open or close the exhaust hole.

* * * * *